United States Patent [19]

Barclay et al.

[11] Patent Number: 4,693,150

[45] Date of Patent: Sep. 15, 1987

[54] PAPER CUTTING ATTACHMENT

[75] Inventors: William Barclay, 2042 Whitefield, Dearborn Heights, Mich. 48127; Alexander C. Stanis, Milan, Mich.

[73] Assignee: William Barclay, Dearborn Heights, Mich.

[21] Appl. No.: 749,630

[22] Filed: Jun. 28, 1985

[51] Int. Cl.[4] ..... B26D 1/16; B26D 3/16

[52] U.S. Cl. ..... 82/93; 83/478; 83/490

[58] Field of Search ..... 30/296 R; 82/93-96, 82/99; 242/56.2, 56.3, 56.4, 56.5, 56 R; 83/478, 490

[56] References Cited

U.S. PATENT DOCUMENTS

| | | | |
|---|---|---|---|
| 581,377 | 4/1897 | Veeder | 82/93 |
| 747,544 | 12/1903 | Fromm | 82/92 X |
| 1,356,900 | 10/1920 | Barber . | |
| 1,714,395 | 5/1929 | Neidich et al. | 82/93 |
| 1,951,140 | 3/1934 | Fahrney | 82/97 |
| 2,168,035 | 8/1939 | Kitcat . | |
| 2,326,293 | 8/1943 | Gast | 82/93 |
| 2,521,385 | 9/1950 | Marion | 82/96 X |
| 2,759,543 | 8/1956 | Conti . | |
| 3,152,500 | 10/1964 | Watts . | |

*Primary Examiner*—Frank T. Yost

*Attorney, Agent, or Firm*—Rhodes and Boller

[57] ABSTRACT

A paper cutting attachment for a drum type plotting apparatus for a computer. The attachment comprises a round slender cross-shaft adapted for mounting to the plotting apparatus. A cutter head is carried on the cross-shaft and is free to rotate and translate on the cross shaft. The cutter head has a circular cutting blade and guard means to protect the operator against injuries from the cutting blade. Means are provided for mounting the cross-shaft to the drum type plotting apparatus.

2 Claims, 10 Drawing Figures

PAPER CUTTING ATTACHMENT

BACKGROUND OF THE INVENTION

Although computer generated graphics is relatively recent in origin, it has already established itself as a significant technological development with applications to engineering, architecture and product design. The application of computer graphics to these fields is exceedingly wide and ranges from dimensioned orthographic component drawings, fourier anaylsis in complex vibration problems to the drawing of architectural plans and perspective illustrations.

The drum type plotting apparatus is a common output device for generating the output of computer graphics programs. In a drum type plotting apparatus, a continuous length of paper is stored on a rotating drum and graphic information is added to the paper by an ink pen whose position is made to vary on the paper by the rotary motion of the drum (X-axis) and the lateral motion of a carriage on which the pen is mounted (Y-axis). Some drum type plotters can generate plots up to 120 feet in length.

During the time graphic information is added, the output is collected on a take-up reel of tne apparatus. In the current practice, after the plotting is completed, the take-up reel is removed from the plotting apparatus and, generally, the side margins of the paper are trimmed and the paper divided or sized to narrower widths.

Heretofore, it has been necessary to trim and divide the paper by hand with scissors or other hand trimming devices. This practice has been time consuming and expensive. With the foregoing in mind, a paper cutting attachment for a drum type plotting apparatus is needed and would provide a substantial economic benefit.

SUMMARY OF THE INVENTION

The present invention is related to paper cutters and more particularly to a paper cutting attachment for a drum type plotting apparatus.

There is provided in the paper cutter a round slender horizontal cross-shaft for laterally and rotatably positioning a cutter head, means for mounting the cross-shaft in parallel spaced relationship to the take-up reel of a drum type plotting apparatus and at least one cutting head which is free to move radially about the center of the cross-shaft and laterally along the shaft.

Rotatably mounted to a housing of the cutting head is a circular cutting blade having a sharp cutting edge whose included angle is about 13 degrees. There is provided in the housing a finger tab for manually moving the cutting blade to the desired location and engaging the blade with the paper. There is also provided a pivoting guard plate which exposes the cutting edge when the blade is moved against the paper and returns to its initial position when the blade is moved out of contact with the paper.

After plotting has been completed, the output on the take-up reel is severed from the blank paper on the paper drum, the cutting head is moved to the desired location and the blade is engaged with the paper on the take-up reel. During the rotation of the take-up reel the cutting blade is advanced by the machine operator into the roll of paper on the take-up reel by exerting a pressure on the finger tab. After the cutting has been completed, the cutting head is moved laterally to another location to continue the trimming or dividing of the paper. When no further cutting is required, the cutting head is parked away from the take-up reel.

It is a primary object of the present invention to provide an inexpensive, simple, readily installed and easy to operate means for dividing and trimming the output of a drum type plotter.

It is another object in addition to the foregoing object to provide a paper cutting attachment which can be easily adapted to a variety of existing drum type plotting apparatus.

It is another object in addition to the foregoing objects to reduce the time and cost of producing the graphical output of a computer.

Other features, objects and benefits will become apparent from the ensuing description and accompaning drawings which disclose the invention in detail. A preferred embodiment is disclosed in accordance with the best mode contemplated in carrying out the invention.

DESCRIPTION OF THE PREFERRED EMBODIMENT

Figure 1:
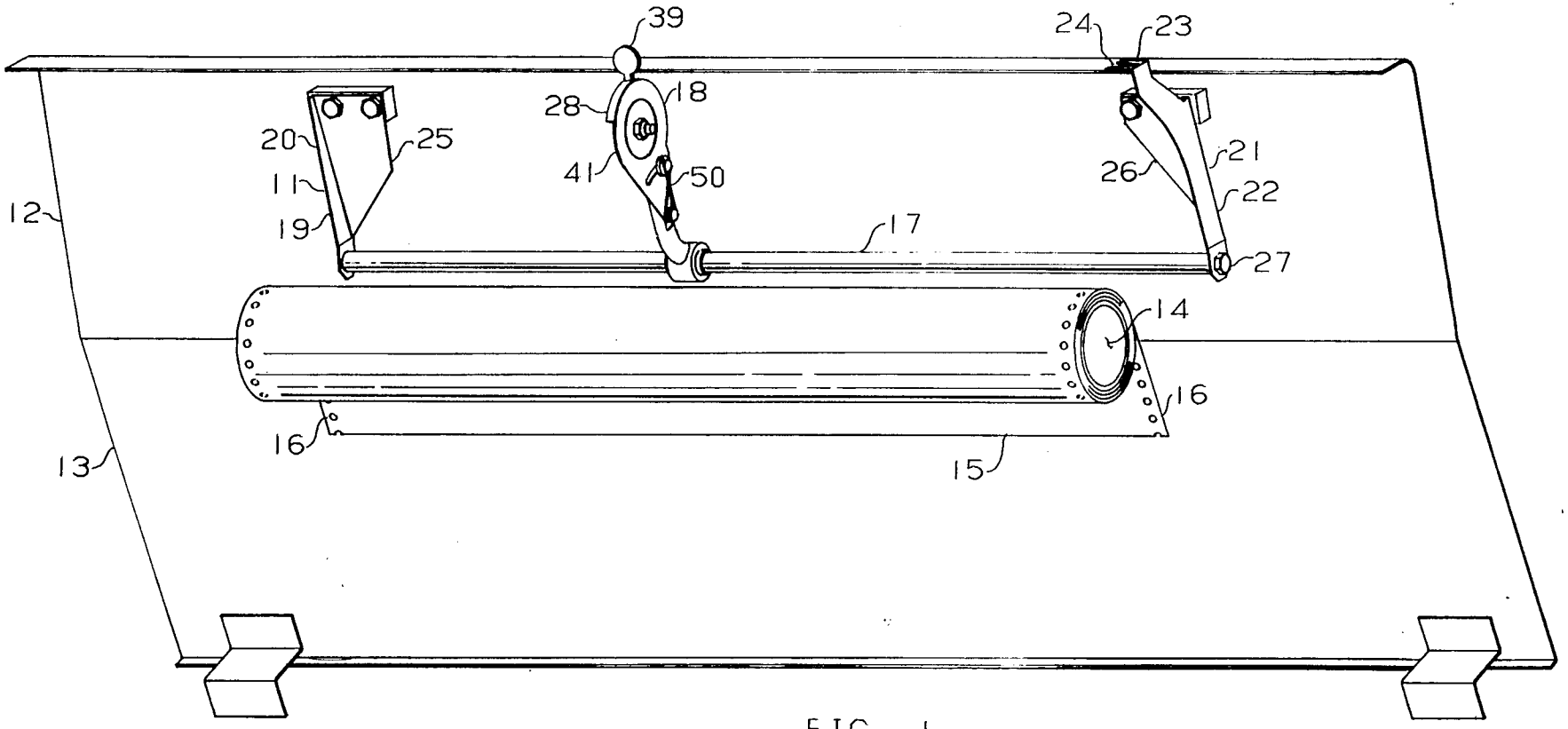
FIG. 1 is a perspective view showing a paper cutting apparatus mounted on the inside surface of a vertical panel of a drum type plotting apparatus.
Figure 2:
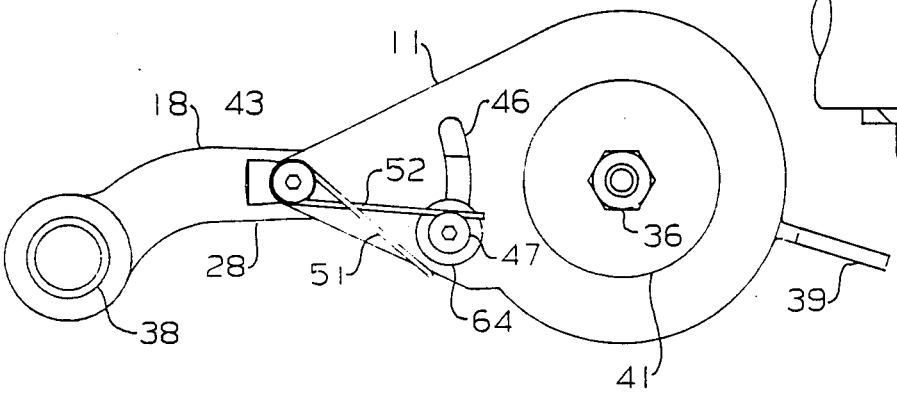
FIG. 2 is a right side view of a cutter head of the paper cutting apparatus.
Figure 5:
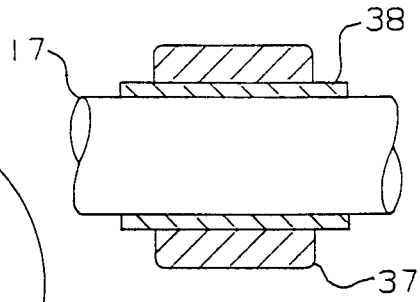
FIG. 5 is a cross-sectional view drawn to an enlarged scale taken on the line 5—5 of FIG. 4.
Figure 6:
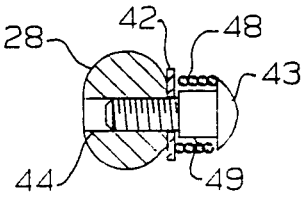
FIG. 6 is a cross-sectional view drawn to an enlarged scale taken on line 6—6 of FIG. 4.

Referring now to the drawings wherein like numerals refer to like and corresponding parts throughout the several views, the present invention of a paper cutter 11 for a drum type plotting apparatus 12 is shown more or less diagrammatically in FIGS. 1 through 8, inclusive. The drum type plotting apparatus 12 is conventional and has a front panel 13, a horizontal take-up reel 14 onto which a continuous length of paper 15 containing the graphic output from a computer is reeled and an access panel (not shown) for gaining access to the paper 15 on the take-up reel 14. At the end margins of the paper 15 are perforations 16 which engage teeth of a tractor feed (not shown) of the plotting apparatus 12 for accurately controlling the position of the paper 15. Means (not shown) are provided in the plotting apparatus 12 for mounting and driving the take-up reel 14.

With reference to FIG. 1, there is provided in the paper cutter 11 a round slender horizontal cross-shaft 17 for carrying a cutter head 18. The cross-shaft 17 is non-rotating and is positioned in parallel spaced relationship to the take-up reel 14. One end portion of the cross-shaft 17 is fixed to a lower end portion of an inward projecting vertical leg 19 of a left side L-bracket 20 and the other end portion of the cross-shaft 17 is fixed to a lower end portion of an inward projecting vertical leg 21 of a right side L-bracket 22. At the top portion of the vertical leg 21 of the right side bracket 22 is an adjoining horizontal leg 23. The horizontal leg 23 contains a slot 24 for, as will be later seen, parking the cutter head 18 when the paper cutter 11 is not in use.

Adjoining the inward projecting vertical leg 19 of the left side bracket 20 is an apertured lateral leg 25 for attaching the left side bracket 20 to the plotting apparatus 12 and a similar apertured lateral leg 26 adjoins the vertical leg 21 of the right side bracket 22 for attaching the right side bracket 22. There are provided threaded fasteners 27 for fixedly attaching the cross-shaft 17 to the brackets 20 and 22 and attaching the brackets 20 and 22 to the apparatus panel 13. Referring now to FIGS. 2 through 8, inclusive, there is provided a single cutter head 18 having a housing 28, a circular cutting blade 29 rotatably mounted to the housing 28 and a safety guard 30 for preventing injuries to a machine operator from the sharp cutting edge 31 of the blade 29. The cutter head 18 is free to rotate about the center of the cross-shaft 17 and to translate laterally along the cross-shaft 17.

Figure 3:
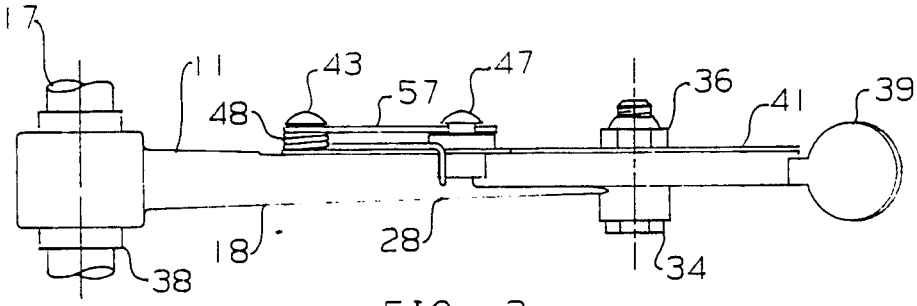
FIG. 3 is a bottom view of the cutter head.
Figure 7:
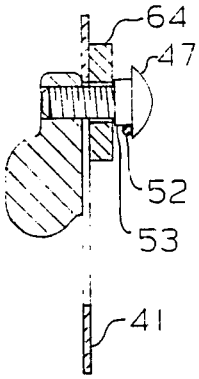
FIG. 7 is a cross-sectional view drawn to an enlarged scale taken on the line 7—7 of FIG. 4.
Figure 4:
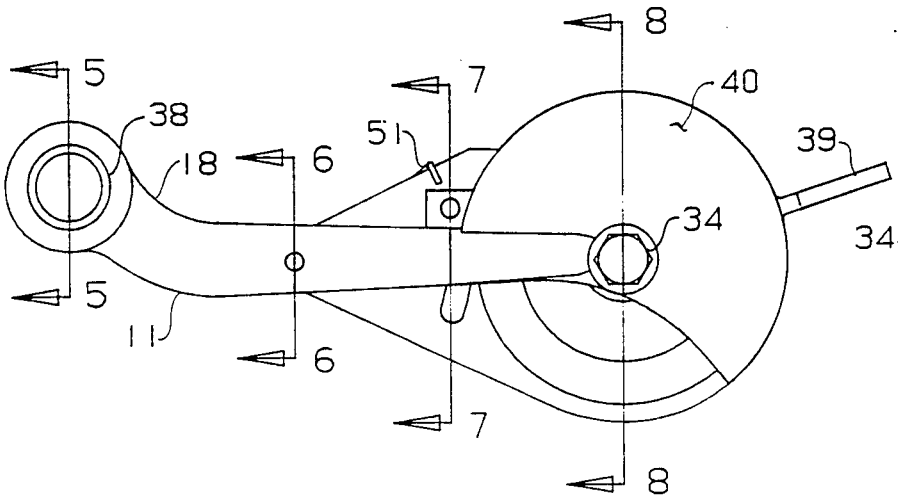
FIG. 4 is a left side view of the cutter head.
Figure 8:
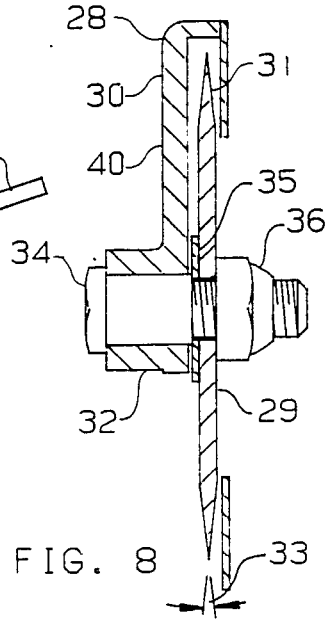
FIG. 8 is a cross-sectional view drawn to an enlarged scale taken on the line 8—8 of FIG. 4.

The construction of the cutter head housing 28 is best seen in FIGS. 3 and 4. There is provided in the housing 28 an apertured boss 32 for mounting the thin circular cutting blade 29 whose cutting edge has an included angle 33 of preferably about 13 degrees. The cutting blade 29 is free to rotate and is mounted to the housing 28 with a hex head shoulder bolt 34, a thrust washer 35 and nut 36. There is also provided in the housing 28 a boss 37 at one end portion which is press fitted with a bushing 38 for supporting the cutter head 18 on the cross-shaft 17 and a finger tab 39 at the other end portion for manually moving the cutter head 18 on the cross-shaft 17.

The safety guard 30 is comprised of a recessed crescent shaped portion 40 of the housing 28 adjacent to one side of the cutting blade 29 and a thin moveable metal guard plate 41 adjacent to the other side of the blade 29. The moveable guard plate 41 is pivotally attached to the housing 28 with a washer 42 and round socket head shoulder bolt 43 which engages a threaded aperture 44 of the housing 28. The portion of the moveable guard plate 41 adjacent to the nut 36 which attaches the blade 29 to the housing 28 has a rather large aperture 45 to clear the nut 36 when the guard plate 41 is pivoted about its point of attachment. An arcuate slot 46 in the guard plate 41 receives a round socket head shoulder bolt 47 with a washer 64. The bolt 47 is in threaded engagement with the housing 28.

Positioned around the shoulder portion 48 of the guard plate pivot bolt 43 are the coils 49 of a helical spring 50 which return the guard plate 41 to its initial position when the cutting blade 29 is disengaged from the take-up reel 14. One end portion 51 of the helical spring 50 bears against an edge of the guard plate 41 and the other end portion 52 of the spring 50 bears against the shoulder 53 of the bolt 47 which extends through the arcuate slot 46 in the guard plate 41.

The manner of using the invention is as follows. After the drum plotter 12 has completed the addition of graphical information on the paper 15, an access panel (not shown) of the plotting apparatus 12 is opened and the paper 15 which is contained on the take-up reel 14 is severed with a conventional hand cutting implement (not shown) from the remaining paper 15 on the paper drum (not shown).

The finger tab 39 of the cutter head 18 is then disengaged from the slot 24 in the right side cross-shaft bracket 26 and the cutter head 18 is first moved laterally and then rotated downwardly to engage the sharp edge 31 of the cutting blade 29 with the paper 15 on the take-up reel 14. The controls of the plotting apparatus 12 are next actuated by the operator to rotatably drive the take-up reel 14 with the drive means (not shown) of the plotting apparatus 12.

During the rotation of the take-up reel 14 the cutting blade 29 is advanced by the machine operator into the paper 15 by exerting pressure on the finger tab 39. As the cutting blade 29 advances into the paper 15, the moveable guard plate 41 is urged to pivot and further expose the blade 29. After cutting has been completed, the cutting head 18 is moved laterally to another location to continue the trimming or dividing of the paper 15. When no further cutting is required, the cutting head 18 is moved away from the take-up reel 14 and parked by moving the cutter head 18 with the finger tab 39 and engaging the finger tab 39 with the slot 24 in the right side bracket 22.

Figure 9:
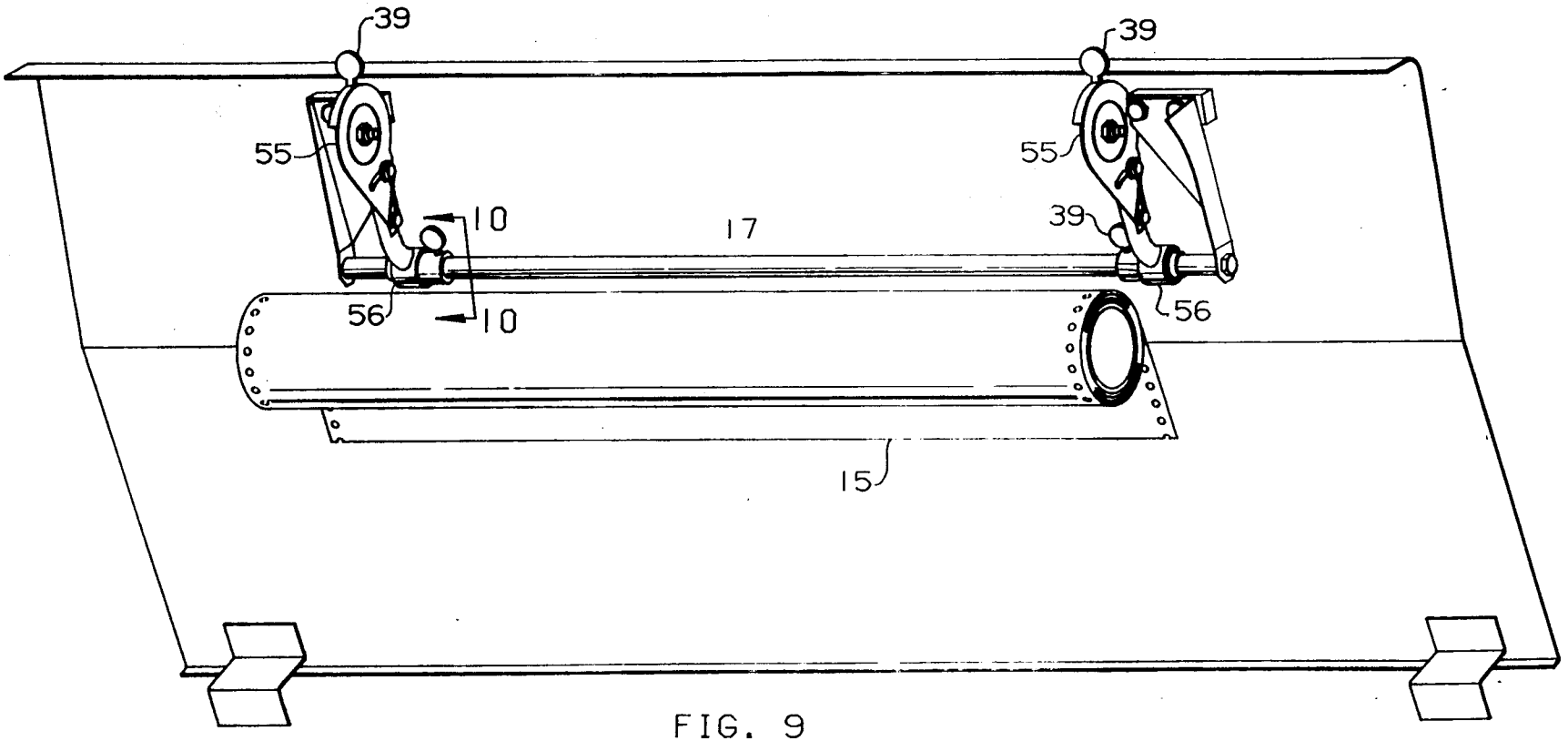
FIG. 9 is a perspective view of an alternate embodiment with cutting heads mounted on the inside surface of a vertical panel of a drum type plotting apparatus.
Figure 10:
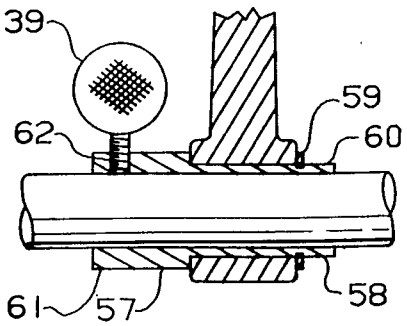
FIG. 10 is a cross-sectional view drawn to an enlarged scale taken on the line 10—10 of FIG. 9.

With reference to FIGS. 9 and 10, an alternate embodiment 54 of the present invention is disclosed therein having a pair of cutting heads 55 mounted on the cross-shaft 17. The alternate embodiment 54 provides the additional advantage of reducing the cutting time by the simultaneous operation of both cutting heads 55. Except for the inner end portion 56 of the cutting heads 55, which will be described, this embodiment 54 is in all respects the same as the aforedescribed embodiment 11.

At the inner end portions 56 of the cutting heads 55 there is provided a stepped bushing 57 on which the cutting heads 55 are free to rotate. At the small diameter end portion 58 of the stepped bushing 57 there is provided a circular groove 59 which receives a retaining ring 60 and laterally retains the cutting head 55 on the stepped bushing 57. At the larger diameter end portion 61 of the bushing 57 there is provided a threaded aperture 62 which receives a thumb screw 63. When the thumb screw 63 is fully tightened, the position of the cutting head 55 is laterally fixed on the cross-shaft 17. Although two cutting heads 55 are provided, only one 55 may be used for cutting paper 15 on the take-up reel 14. When the cutter heads 55 are not in use, they are rotated upwardly over center to rest against the drum plotter panel 13.

From the foregoing it is plain that our invention provides a simple, effective and easy to use paper cutting apparatus which is adaptable to existing drum type plotting apparatus.

Although but two embodiments of our invention have been disclosed herein, it is obvious that changes can be made in the size, shape, arrangement and detail of what has been disclosed without departing from the spirit and scope thereof as defined by the appended claims.

We claim:

1. Paper cutting attachment for a drum type computer plotting apparatus wherein paper is accumulated in a roll on a take-up drum and thereafter trimmed and divided by a user comprising in combination:

(a) a slender circular cross-shaft for mounting a paper cutter head at parallel spaced relationship to a take-up reel of a drum type plotting apparatus; and (b) at least one paper cutter head mounted for rotation and translation on the cross-shaft having a housing with an aperture at one end for receiving a stepped bushing, a stepped bushing engaging said housing aperture, said bushing having a groove at one end portion for receiving a retaining ring and a threaded aperture at the other end thereof for receiving a thumb screw and a thumb screw in engagement with the threaded aperture of the stepped bushing for laterally fixing the paper cutter head on the cross-shaft.

2. Paper cutting attachment for a drum type computer plotting apparatus wherein paper is accumulated in a roll on a take-up drum and thereafter trimmed and divided by a user comprising in combination:

(a) a rotatable slender circular cross-shaft adapted for mounting a cutter head in parallel spaced relationship to a rotating take-up drum of a drum type computer plotting apparatus;

(b) at least one paper cutter head fixedly mounted to said cross-shaft, said cutter head having a housing, a circular cutting blade rotatably mounted in said housing, a means for fixedly mounting the cutter head at a pre-selected lateral position on the cross-shaft, guard means for preventing injuries from said cutting blade and manual means for rotating the cross-shaft to engage the cutting blade with the roll of paper on the take-up drum to trim and divide the paper;

(c) a first bracket for receiving and rotatably mounting one end of the cross-shaft to a cabinet of said computer plotting apparatus, said first bracket having means for holding the cutting blade away from the take-up roll when the cutting attachment is not in use; and (d) a second bracket for receiving and rotatably mounting the other end of the cross-shaft to the cabinet of the computer plotting apparatus.

* * * * *